US011472692B2

(12) United States Patent
Rusch

(10) Patent No.: US 11,472,692 B2
(45) Date of Patent: Oct. 18, 2022

(54) TOUCH-FREE FLOWABLE FOOD PRODUCT DISPENSER

(71) Applicant: SERVER PRODUCTS, INC., Richfield, WI (US)

(72) Inventor: Gerald A. Rusch, Fond du Lac, WI (US)

(73) Assignee: SERVER PRODUCTS, INC., Richfield, WI (US)

( * ) Notice: Subject to any disclaimer, the term of this patent is extended or adjusted under 35 U.S.C. 154(b) by 0 days.

(21) Appl. No.: 17/193,575

(22) Filed: Mar. 5, 2021

(65) Prior Publication Data

US 2022/0024749 A1 Jan. 27, 2022

Related U.S. Application Data

(63) Continuation of application No. 17/108,468, filed on Dec. 1, 2020, now Pat. No. 10,961,105.

(Continued)

(51) Int. Cl.

*B67D 1/08* (2006.01)
*B67D 1/10* (2006.01)

(Continued)

(52) U.S. Cl.

CPC ..... *B67D 1/0888* (2013.01); *A47G 19/183* (2013.01); *B67D 1/10* (2013.01); *B67D 1/1202* (2013.01)

(58) Field of Classification Search

CPC ..... B67D 1/0888; B67D 1/10; B67D 1/1202; A47G 19/183

See application file for complete search history.

(56) References Cited

U.S. PATENT DOCUMENTS 4,722,372 A 2/1988 Hoffman et al.
4,921,150 A 5/1990 Lagergren et al.

(Continued)

FOREIGN PATENT DOCUMENTS

JP H8-35487 2/1996
JP 2000145646 A 5/2000

OTHER PUBLICATIONS

"How to make touch free automatic [sauce] dispenser" video at https://www.youtube.com/watch?v=Yv-pR7XO95s Mumbai. Posted Jul. 5, 2020. Accessed Jul. 2, 2021.

(Continued)

*Primary Examiner* — Frederick C Nicolas
(74) *Attorney, Agent, or Firm* — Andrus Intellectual Property Law, LLP

(57) ABSTRACT

A touch-free flowable food product dispenser is disclosed. The food product dispenser includes a main body, a pump assembly mounted in the main body and a cover member mounted to the main body. The cover member is part of an automated pump actuation unit that can be removably mounted to the main body such that the automated pump actuation unit engages a pump assembly supported by the main body. The automated pump actuation unit includes a sensor positioned to detect the presence of an actuation member, such as a hand, in proximity to the sensor. When the actuation member is detected, the automated pump actuation unit actuate the pump assembly to dispense the food product. The cover member and automated pump actuation assembly are formed as a single unit that can be installed on the main body to convert manual pump dispensers to touch-free dispensers.

10 Claims, 9 Drawing Sheets

Related U.S. Application Data

(60) Provisional application No. 63/055,508, filed on Jul. 23, 2020.

(51) Int. Cl.
*B67D 1/12* (2006.01)
*A47G 19/18* (2006.01)

(56) References Cited

U.S. PATENT DOCUMENTS

| | | | | |
|---|---|---|---|---|
| 5,452,826 | A | 9/1995 | Stern | |
| 5,492,247 | A | 2/1996 | Shu et al. | |
| 5,611,465 | A | 3/1997 | Lee et al. | |
| 6,036,056 | A | 3/2000 | Lee et al. | |
| 6,089,406 | A | 6/2000 | Feldner | |
| 6,152,330 | A | 11/2000 | Polan | |
| 6,189,736 | B1 | 2/2001 | Phallen et al. | |
| 6,390,329 | B1 | 5/2002 | Maddox | |
| 6,431,400 | B1 | 8/2002 | O'Maley et al. | |
| 6,533,145 | B2 | 3/2003 | Lewis et al. | |
| 6,662,971 | B1 | 12/2003 | Nguyen et al. | |
| 7,007,824 | B2 * | 3/2006 | Danby | B65D 77/30 222/103 |
| 7,011,233 | B2 | 3/2006 | Drennow | |
| 7,028,861 | B2 | 4/2006 | Sayers et al. | |
| 7,281,643 | B2 | 10/2007 | Lin | |
| 7,527,178 | B2 | 5/2009 | Lewis | |
| 7,611,030 | B2 | 11/2009 | Reynolds et al. | |
| 7,621,426 | B2 | 11/2009 | Reynolds et al. | |
| 8,096,445 | B2 | 1/2012 | Yang et al. | |
| 8,172,555 | B2 | 5/2012 | Reynolds | |
| 8,240,508 | B2 | 8/2012 | Wegelin et al. | |
| 8,336,740 | B1 | 12/2012 | Daansen | |
| 9,809,439 | B2 | 11/2017 | Falco, III | |
| 10,373,477 | B1 | 8/2019 | Bonner et al. | |
| 10,464,800 | B2 | 11/2019 | Hevia et al. | |
| 10,961,105 | B1 * | 3/2021 | Rusch | B67D 1/1202 |
| 2005/0127090 | A1 | 6/2005 | Sayers et al. | |
| 2006/0231577 | A1 | 10/2006 | Powling et al. | |
| 2006/0249531 | A1 | 11/2006 | Litchfield | |
| 2007/0000941 | A1 | 1/2007 | Hadden et al. | |
| 2009/0261124 | A1 | 10/2009 | Boll et al. | |
| 2010/0308076 | A1 | 12/2010 | Snodgrass | |
| 2011/0062183 | A1 | 3/2011 | Wiemer et al. | |
| 2011/0108578 | A1 | 5/2011 | Wegelin et al. | |
| 2011/0253744 | A1 | 10/2011 | Pelfrey | |
| 2011/0278322 | A1 | 11/2011 | Reynolds et al. | |
| 2013/0037575 | A1 | 2/2013 | Van Der Molen | |
| 2013/0134183 | A1 | 5/2013 | Van Diepen et al. | |
| 2014/0231460 | A1 | 8/2014 | Pelkey et al. | |
| 2014/0263427 | A1 | 9/2014 | Muderlak et al. | |
| 2015/0090737 | A1 | 4/2015 | Ciavarella et al. | |
| 2016/0068383 | A1 | 3/2016 | Falco, III | |
| 2020/0062572 | A1 | 2/2020 | Hevia et al. | |
| 2020/0069089 | A1 | 3/2020 | Gehl et al. | |
| 2020/0282414 | A1 | 9/2020 | Gauger et al. | |
| 2020/0404405 | A1 | 12/2020 | Hunt | |

OTHER PUBLICATIONS

International Search Report and Written Opinion for International Application No. PCT/US2021/025165 dated Jun. 22, 2021.

* cited by examiner

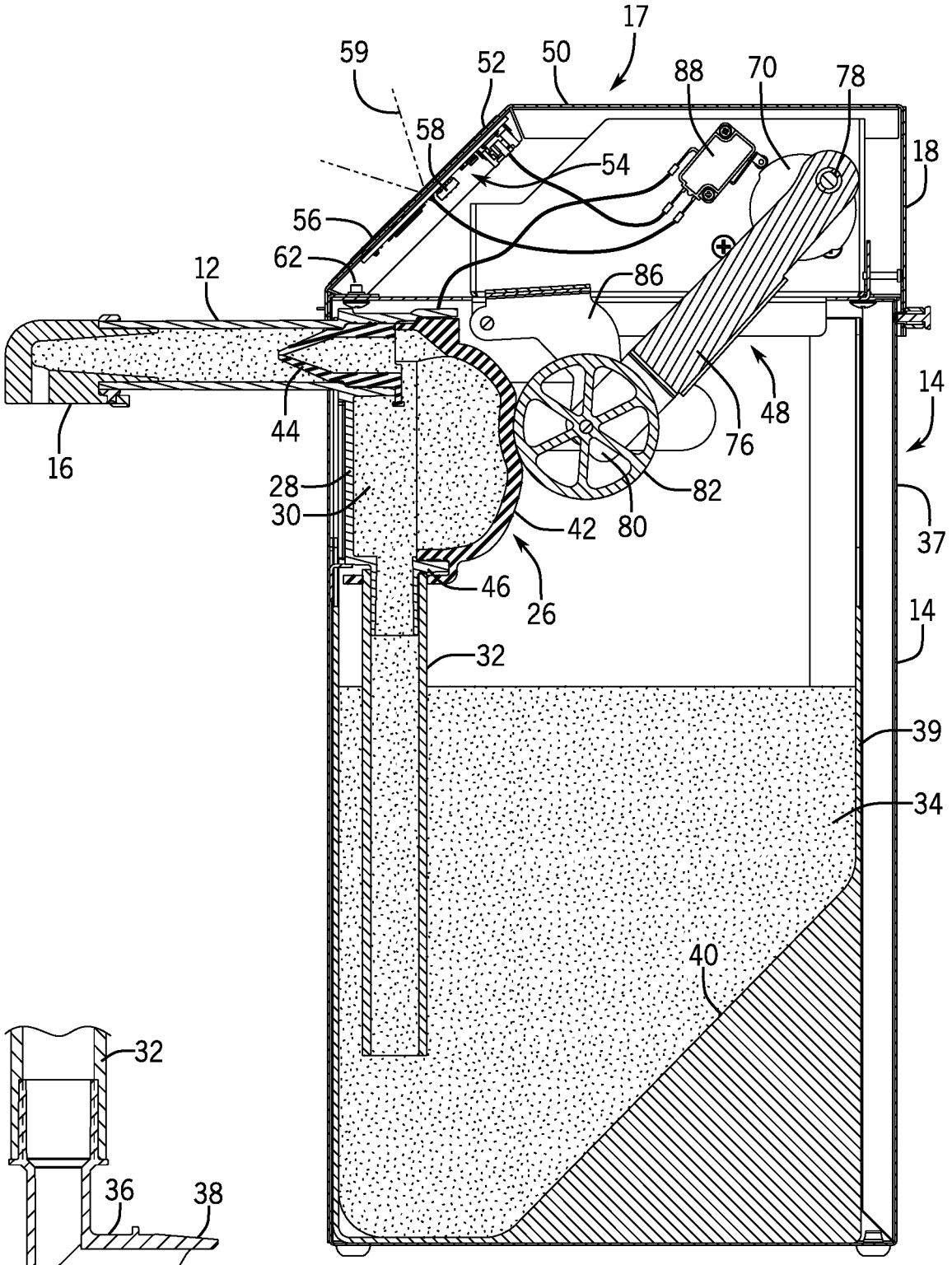
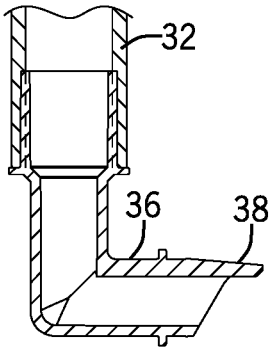
FIG. 5A
FIG. 5

TOUCH-FREE FLOWABLE FOOD PRODUCT DISPENSER

CROSS REFERENCE TO RELATED APPLICATION

The present application is a continuation application that is based on and claims priority to U.S. patent application Ser. No. 17/108,468, filed on Dec. 1, 2020, now U.S. Pat. No. 10,961,105, which in turn is based on and claims priority to U.S. Provisional Patent Application Ser. No. 63/055,508 filed on Jul. 23, 2020, the disclosure of which is incorporated herein by reference.

BACKGROUND

The present disclosure generally relates to the automatic dispensing of a flowable food product, such as condiments, from a storage container or pouch. More specifically, the present disclosure relates to a sanitary, touch-free automatic flowable food product dispensing apparatus and method to use such apparatus.

Flowable food products can include a wide variety of products, such as condiments (i.e. ketchup, mustard, mayonnaise, tartar sauce, etc.), syrups, dressings, cheeses, fudge, caramel or other similar food products that can flow and thus be pumped. At many restaurants or other food service locations, flowable food products are dispensed utilizing a manual pump from a reservoir containing the food product. Such pumps typically include a flexible diaphragm pump mounted to a main body that includes an open interior sized to receive a supply of the food product to be dispensed. These dispensers typically rely upon the manual action of a handle or lever that must be depressed by the user to depress and release a flexible diaphragm of the diaphragm pump. The depression of the handle creates pressure onto the diaphragm which, upon release, creates a negative source of pressure to draw the food product from the open reservoir.

One problem with manual pumps is that the pump handle collects bacteria or viruses since multiple users touch the same pump handle during daily usage. Typically, the pump handle is not sanitized during use in a single day and is sanitized only at the end of a day or the beginning of the next day. For this reason, the pump handle provides a point for possible contamination from the multiple users.

The present disclosure utilizes a common pumping mechanism, such as a flexible diaphragm pump, in combination with an automated pump actuator to eliminate the need for a manual pump handle.

SUMMARY

The present disclosure relates to a touch-free flowable food product dispenser. The touch-free food product dispenser includes a sensor that detects the presence of the hand of a user above a sensing area. Upon detection of the presence of the user, an automated pump actuation unit operates a pump assembly to dispense a volume of food product from the food product dispenser. The automated pump actuation unit is designed to be removable from the main body of the dispenser as a single unit, which allows for the conversion of mechanical food product dispensers that include a manual actuation handle to touch-free dispensers.

The flowable food product dispenser of the present disclosure is designed to be operable to selectively dispense a food product as desired by a user. The dispenser includes a main body that has an open interior sized to receive a supply of food product to be dispensed. The main body receives and supports a pump assembly. The pump assembly can be a flexible diaphragm pump that is securely mounted to the main body. The pump assembly includes a first end in fluid communication with the supply of flowable food product and a second, dispensing end that extends from the main body.

The food product dispenser can include an automated pump actuation unit that is operable to actuate the pump assembly. When the automated pump actuation unit actuates the pump assembly, the food product is dispensed from the pump assembly. A sensor is positioned to detect the presence of an actuation member in proximity to the sensor but out of contact with the sensor. In one embodiment, the actuation member can be a hand of the user. When the sensor detects the presence of a hand of the user, the pump actuator automatically actuates the pump assembly. In this manner, the product dispenser can operate touch-free to dispense food product.

The automated pump actuation unit can include a removable cover member and the sensor can be mounted within the cover member. The automated pump actuation unit can include an electric drive motor within the cover member that is operable by a control unit to selectively depress and release a flexible diaphragm of the pump assembly. Both the drive motor and the control unit are contained within the cover member of the automated pump actuation unit to be removable from the main body as a single unit.

In another contemplated embodiment of the present disclosure, an automated actuation unit is designed for use with a food product dispenser that includes a main body having an open interior and a diaphragm pump supported by the main body. The automated pump actuation unit includes a cover member that is removably mounted to the main body. The automated pump actuation unit is mounted to the cover member and is removable from the main body with the cover member. The automated pump actuation unit is operable to selectively actuate the diaphragm pump when the diaphragm pump is supported by the main body and the cover member is mounted to the main body. The actuation unit can include a sensor positioned on the cover member and operable to detect the presence of a hand of a user in close proximity to the sensor but out of contact with the sensor. A control unit can be included in the cover member and is in communication with the sensor and the automated pump actuation unit. Upon detection of the presence of the hand of the user, the control unit operates the pump actuator to actuate the diaphragm pump to automatically dispense the flowable food product. The automated actuation unit is designed to replace manual pump components such that a manual pump dispenser can be converted into a touch-free dispenser.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 5 is a section view of the food product dispenser;

FIG. 5A is a magnified view of an alternate embodiment of the pump tube;

DETAILED DESCRIPTION

Figure 1:
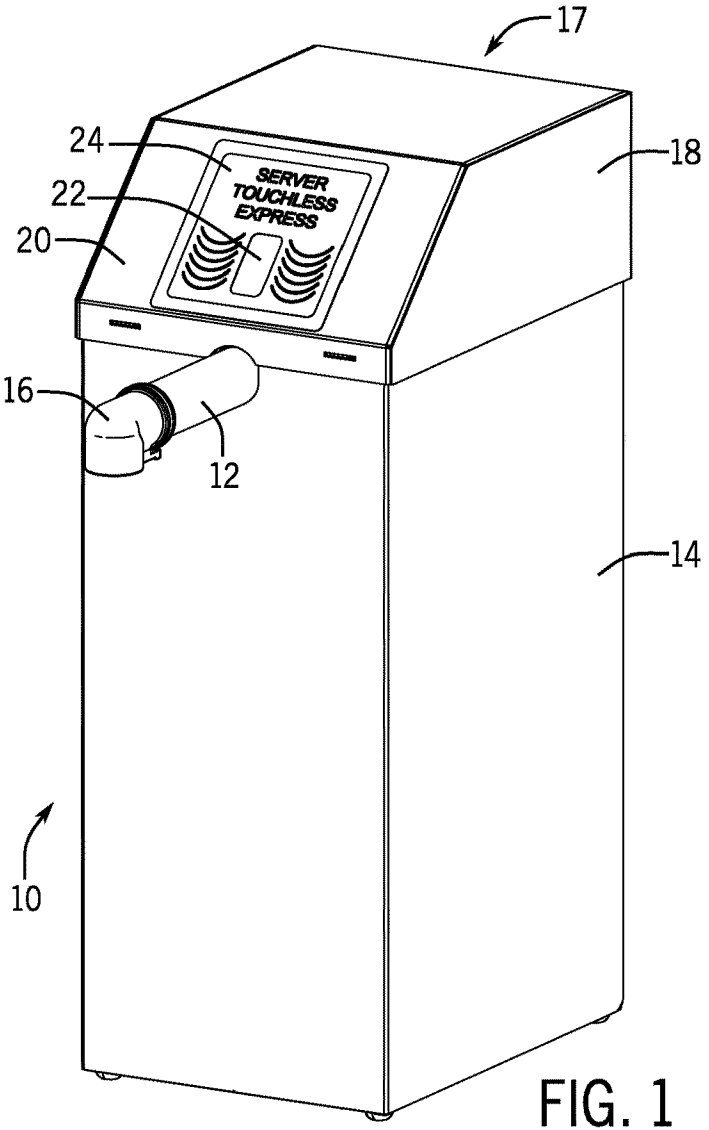
FIG. 1 is a perspective view of the flowable food product dispenser of the present disclosure.

FIG. 1 illustrates a flowable food product dispenser 10 constructed in accordance with an exemplary embodiment of the present disclosure. Throughout the present disclosure, the term "flowable food product" or "food product" is meant to refer to a wide variety of products, such as condiments (i.e. ketchup, mustard, mayonnaise, tartar sauce, etc.), syrups, dressings, cheeses, fudge, caramel or other similar food products that can flow and thus be pumped. These condiments/food products are typically supplied with another food item or are applied to the food item by either the customer or a restaurant worker.

Figure 2:
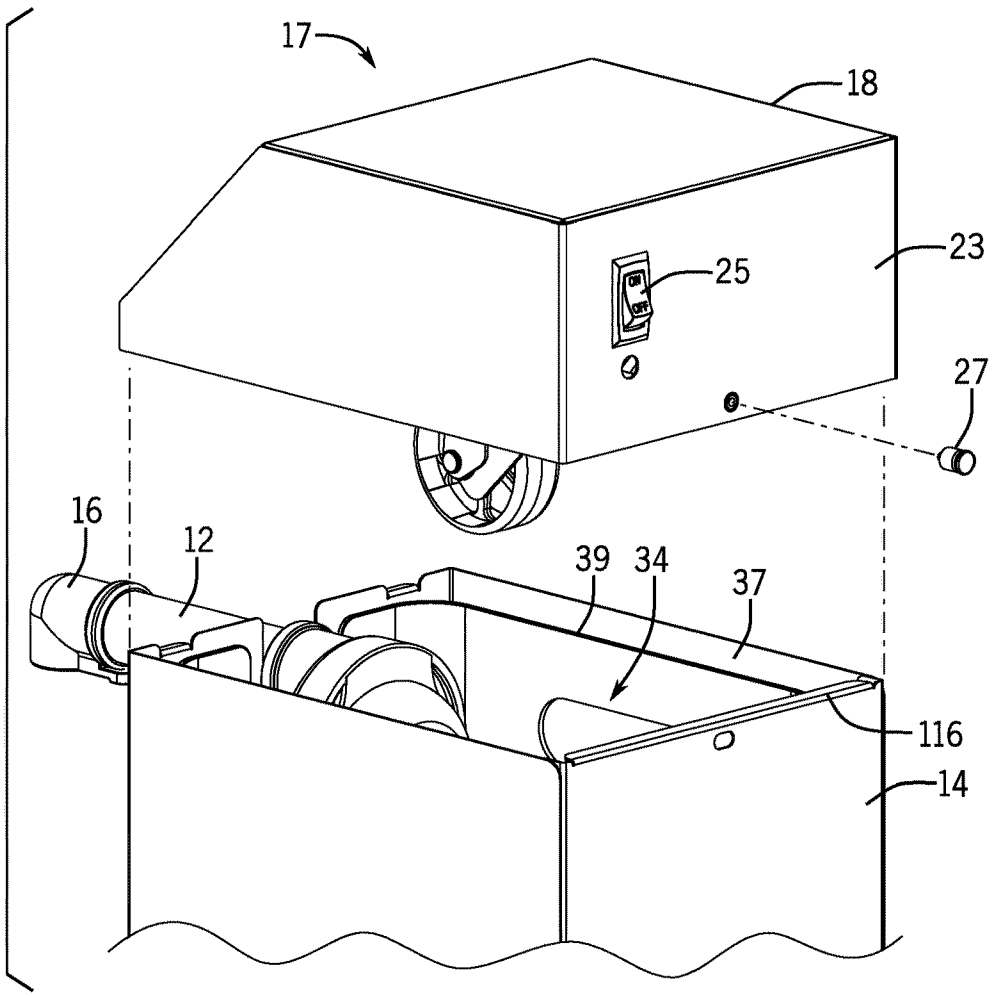
FIG. 2 is a magnified, partially exploded view of the flowable food product dispenser with an automated pump actuation unit removed from the main body.
Figure 3:
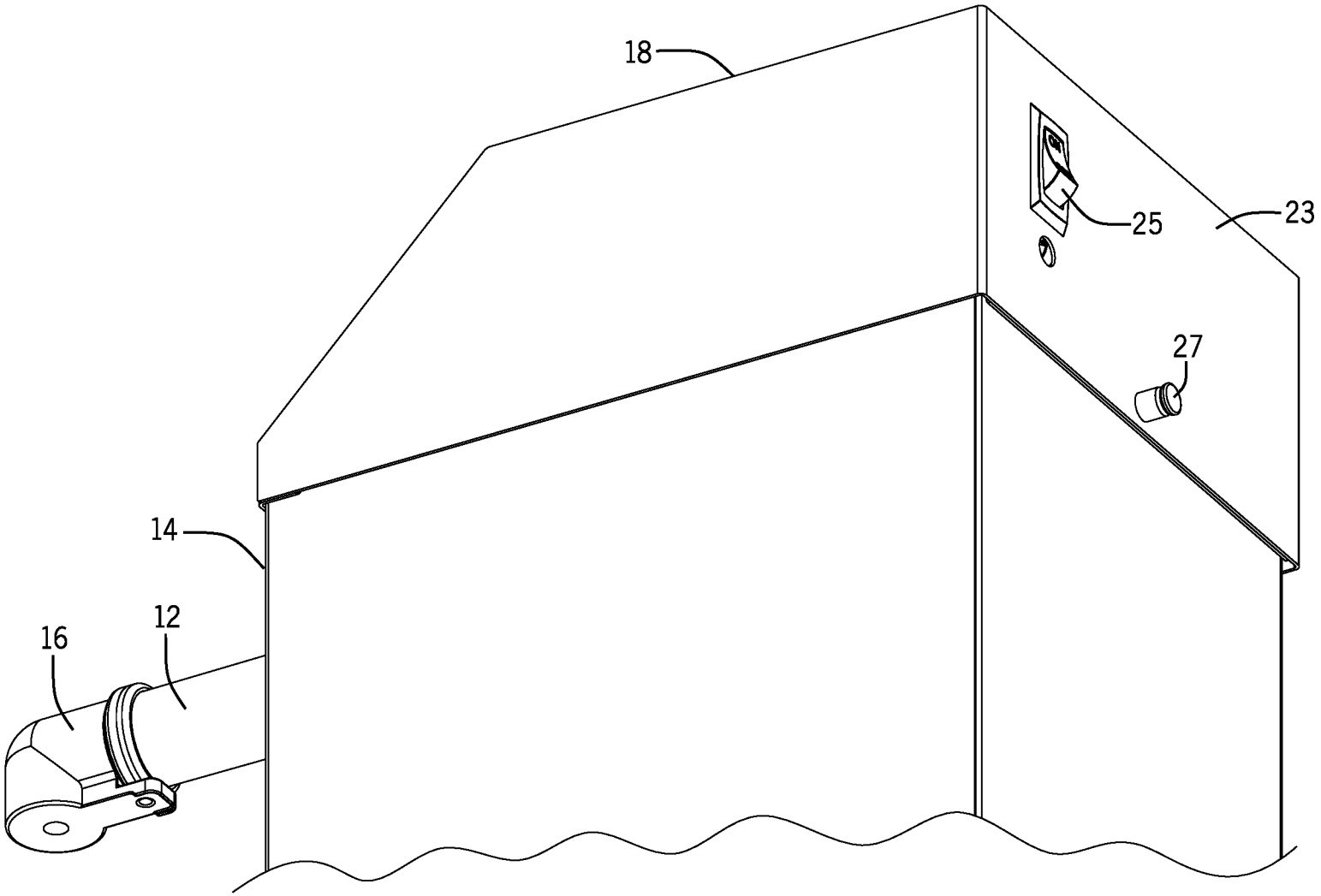
FIG. 3 is a magnified, back view of the food product dispenser with the automated pump actuation unit mounted to the main body.

As can be seen in FIGS. 1-3, the food product dispenser 10 includes a dispensing spout 12 that extends away from a main body 14. The dispensing spout 12 includes an outlet nozzle 16 that directs the food product onto the food item or into a condiment container. In the embodiment shown in FIGS. 1-3, the main body 14 receives an automated pump actuation unit 17 that sits on top of the main body 14 during use of the food product dispenser 10. As shown in FIG. 2, the automated pump actuation unit 17 is removable from the body 14 as a single unit, the significance of which will be described in detail below. The automated pump actuation unit 17 includes a touch-free, automated dispensing mechanism mounted within a cover member 18, the details of which will also be described in greater detail below. Although the automated pump actuation unit 17 is shown mounted within the cover member 18, other configurations are contemplated in which the automated dispensing mechanism could be mounted in other locations, such as within the main body 14, and would not be removable with the cover member 18.

The cover member 18 includes a front face panel 20. The front face panel 20 includes a sensor window 22. The sensor window 22 is typically a clear area that provides the ability for an internal sensor to detect the presence of an actuation member, such as the hand of a user is in close proximity to the sensor. The details of the sensor and control system that form part of the automated pump actuation unit 17 will be described in greater detail below. In the embodiment shown in FIG. 1, the sensor window 22 is contained within a larger sensing area 24 that provides a visual indication to a user where the sensor is located.

In the embodiment shown in FIGS. 1-3, the main body 14 and the outer portions of the cover member 18 are formed from a durable material, such as stainless steel or durable plastic. Such material allows the main body 14 and cover member 18 to be cleaned and sanitized after periods of use. As shown in FIGS. 2 and 3, the back face 23 of the cover member 18 includes a power switch 25 and a connector 27 that secures the cover member 18 to the main body 14.

FIG. 5 is a section view of the food product dispenser 10. In the section view of FIG. 5, the details of a pump assembly 26 are shown. In the illustrated exemplary embodiment, the pump assembly 26 is a standard flexible diaphragm pump that has been utilized to dispense food products utilizing a variety of manual pump based food product dispensers, such as those available from Server Products. Although a flexible diaphragm pump is shown in the figures of the present application, it is contemplated that other pump assemblies could be used while operating within the scope of the present disclosure.

The pump assembly 26 shown includes a hollow dispensing spout 12 that terminates at the nozzle 16. The dispensing spout 12 extends into a pump body 28 that has an internal pumping chamber 30. The pump assembly 26 further includes a pumping tube 32 that extends downward into the open interior 34 defined by the main body 14. The open interior 34 defines a reservoir designed to receive the supply of food product to be dispensed. The food product to be dispensed can be contained in a sealed pouch (not shown) or can be directly poured into the open interior 34 as shown in FIG. 5.

In the alternate embodiment shown in FIG. 5A, the pump tube 32 could include a pouch fitting 36 having a piercing end 38 that is designed to be received within a fitting of a condiment pouch (not shown). However, it is contemplated that the pouch fitting 36 could be removed and the pumping tube 32 could extend down into the supply of food product that is directly contained within the open interior 34 as shown in FIG. 5.

Figure 4:
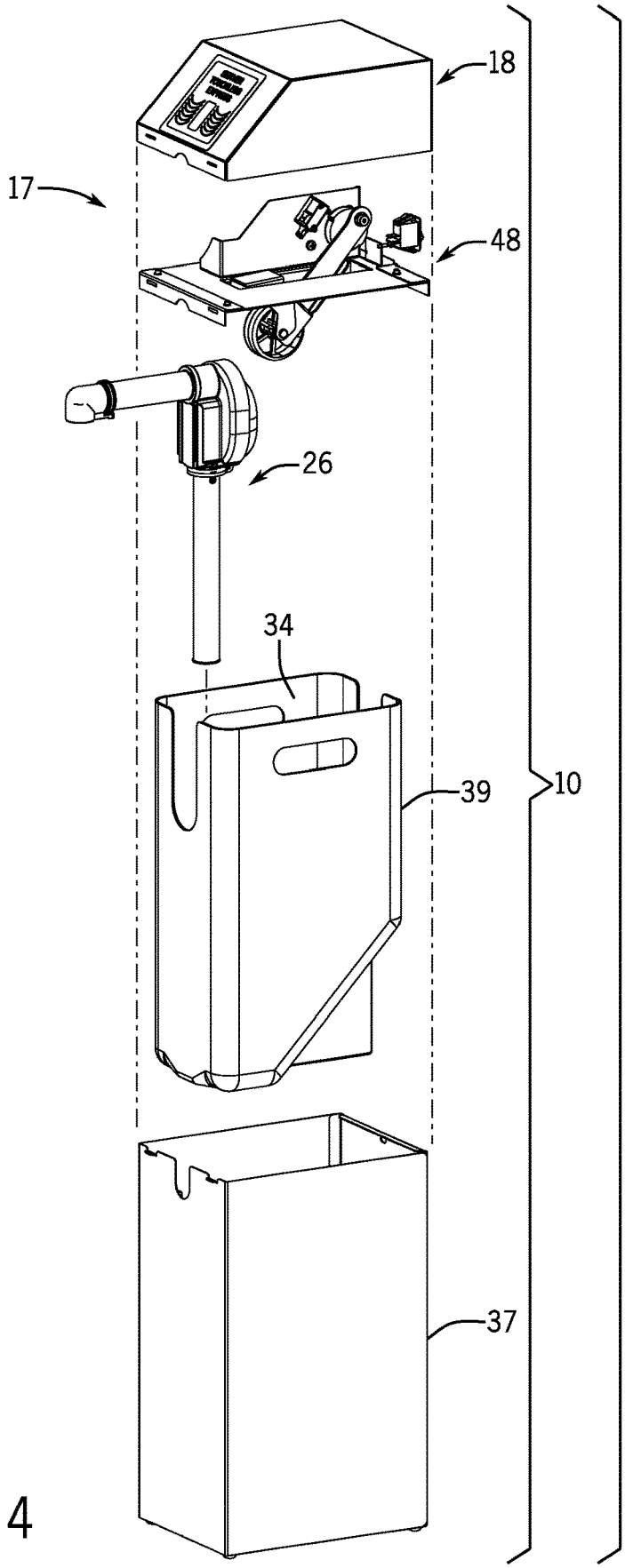
FIG. 4 is an exploded view of the food product dispenser.

In the embodiment shown in FIGS. 4 and 5, the main body 14 of the food product dispenser 10 includes an outer shell 37 that receives a removable liner 39. The removable liner 39 creates the open interior 34 and can be removed from the outer shell 37 for cleaning. As shown in FIG. 5, the liner 39 includes a sloped bottom wall 40 that is used to direct the supply of condiment toward the pumping tube 32, whether the condiment is included in a bag or pouch or is directly received in the open interior 34.

As illustrated in FIG. 5, the pump assembly 26 is securely mounted to the main body 14 such that the pump assembly 26 is supported by the main body 14 independent from the cover member 18. The pump assembly 26 includes a flexible diaphragm 42 that extends from the pump body 28. In normal use, pressure on the flexible diaphragm 42 pushes the food product out of the spout 12 through a one-way discharge valve 44. When pressure is removed from the flexible diaphragm 42, the flexible diaphragm 42 expands and creates a negative source of pressure that draws food product through a second one-way inflow valve 46. The operation of such a flexible diaphragm pump is well-known in the industry. Although a flexible diaphragm pump is shown in the illustrated embodiment, other types of pumps capable of pumping a condiment or liquid food product could be utilized while operating within the scope of the present disclosure. In such embodiments, the pump assembly would be supported on the main body 14 and positioned to draw food product from a supply and dispense the food product out of a spout or discharge end.

In accordance with the present disclosure, the manual pump handle typically used with a flexible diaphragm pump is replaced with a touch free, automated pump actuation unit 17. The automated pump actuation unit 17 includes a mechanical actuator 48 and the cover member 18, which are shown in an exploded view in FIG. 6. In FIG. 5, the mechanical actuator 48 is shown mounted to the interior of the cover member 18 such that the automated pump actuation unit 17 can be removed as a single unit from the main body 14 of the food product dispenser 10 as was shown in FIG. 2. The mechanical actuator 48 operates to depress and release the diaphragm 42 such that the diaphragm acts in a known and conventional manner to pump food product from the food product dispenser. However, in accordance with the present disclosure, the mechanical actuator 48 operates in an automated fashion and eliminates any need for the customer or food service worker to touch a manual handle as in the prior systems.

Figure 6:
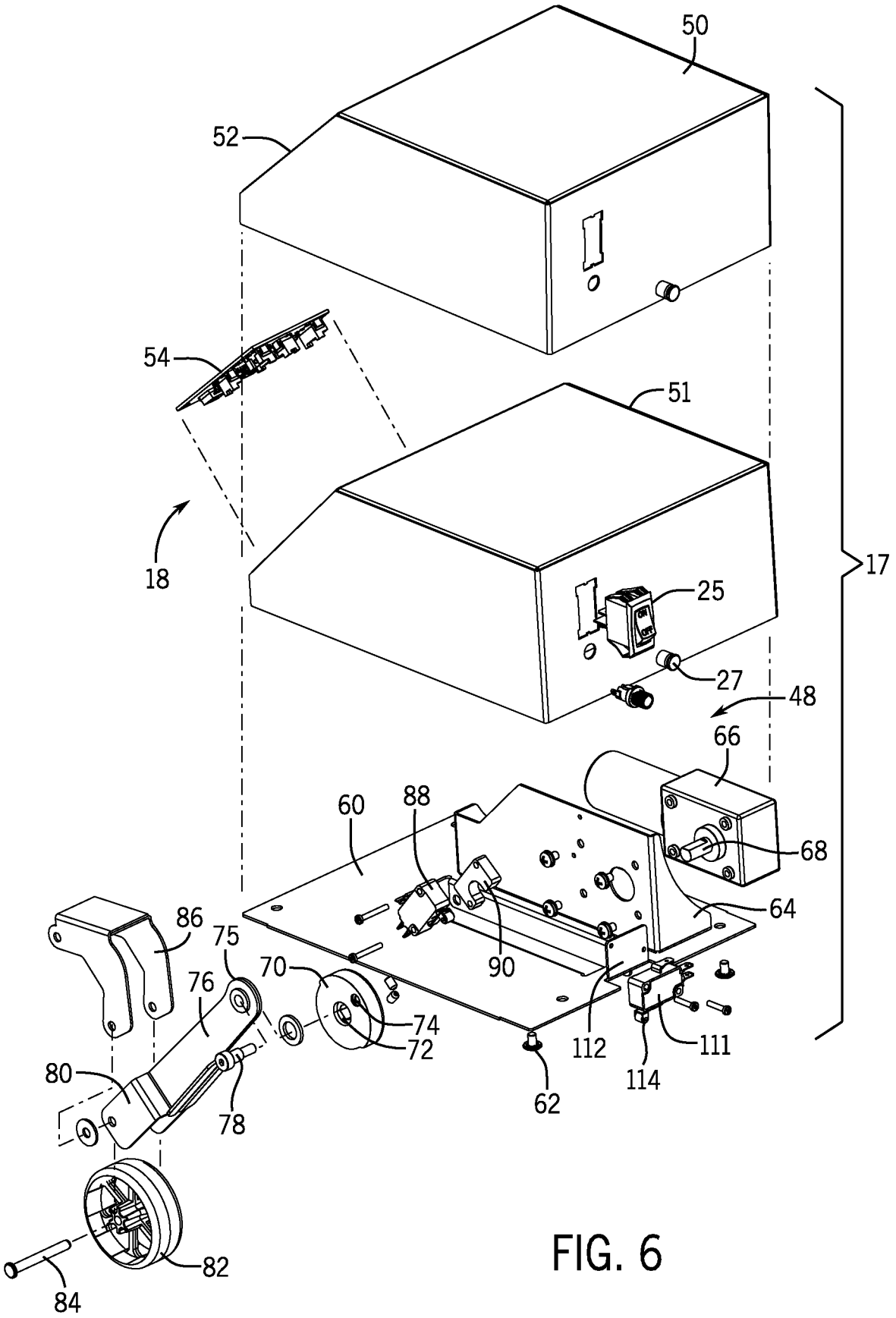
FIG. 6 is an exploded view of the automated pump actuation unit.

Referring now to FIG. 6, the cover member 18 includes an outer hood 50 and an inner hood 51 that are both formed from a metallic material, such as stainless steel. However, it is contemplated that the inner and outer hoods could be formed from another material that is easy to clean, such as plastic. The outer hood 50 includes the sloping front wall 52 that includes the sensing area 24 shown in FIGS. 1 and 2. As can be understood in FIGS. 5 and 6, a control board 54 is mounted to the inner surface 56 of the front wall 52. The control board 54 includes a control unit 61, such as a processor or CPU, along with a variety of other electronic operating components, including a sensor 58 that is designed to be aligned with the sensor window. In one embodiment of the present disclosure, the sensor 58 is a capacitive proximity sensor that can sense the presence of an actuation member, such as user's hand, within a sensing area 59. In an exemplary embodiment, the sensor 58 creates the sensing area 59 in the shape of a sensing cone that extends above the front wall 52. Whenever an actuation member, such as a hand or other body part of a user enters the sensing cone and remains in the sensing cone for a predetermined period of time, such as 1 second, the sensor 58 generates an output signal. In one embodiment, the sensing area 59 created by the sensor 58 extends between one inch and six inches above the front wall 52. Further, although the sensor 58 is contemplated as being a capacitive sensor, other sensor types, such as an inductive sensor, photo sensor or magnetic sensor could be utilized to detect the presence of a user.

Figure 10:
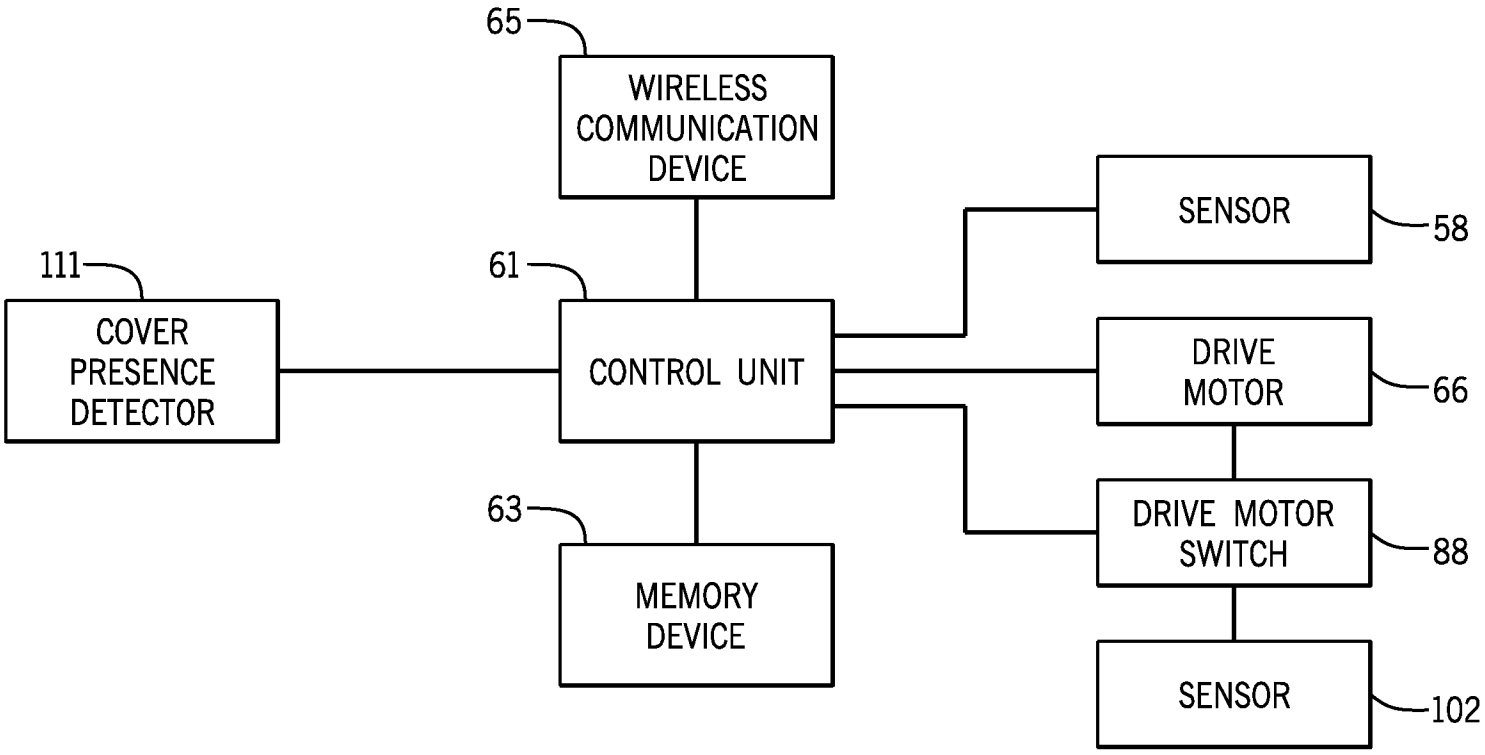
FIG. 10 is an schematic illustration of the operating component of the dispenser.

As shown in FIG. 10, in addition to the sensor 58, the control board 54 includes other operating components, such as a control unit 61 that may be comprised of an operating processor. The control board 54 can also include memory device 63 for storing operating instructions. The control board 54 could also include a wireless communication device 65 that would allow for wireless communication and monitoring of the food product dispenser from a near or remote location. For example, the remote monitoring would allow a foodservice company to monitor the amount of the food product that has been dispensed to predict when the dispenser would need to be refilled.

Referring back to FIG. 6, the mechanical actuator 48 of the automated pump actuation unit 17 includes a support plate 60 that provides operative support for the components of the mechanical actuator 48 within the outer hood 50 of cover member 18 of the automated pump actuation unit 17. The support plate 60 is securely attached to the hood 50 by a series of connectors 62, as can be seen in FIG. 5.

The support plate 60 includes a mounting block 64 that provides a point of connection for an electric drive motor 66. The electric drive motor 66 includes an output drive shaft 68 that extends through the mounting block 64. The electric drive motor 66 is connected to a power supply and controlled by operation of the control unit 61. The power supply for driving the electric drive motor 66 can be either a connection to the utility power in the area near the food product dispenser or could be an internal battery power supply (not shown). The power supply could also include a specifically designed power supply designed to convert utility power to a desired voltage and current source for driving the electric drive motor 66 and the other components on the circuit board 54.

The drive shaft 68 of the drive motor 66 can be connected to a cam 70 through the central attachment opening 72 formed in the cam 70. The cam 70 includes an attachment point 74 that is spaced radially outward from the center of the cam 70. The attachment point 74 provides a point of attachment for a first end 75 of a actuator arm 76. The first end 75 of the actuator arm 76 is connected to first end 75 of the cam 70 through use of a pivot pin 78.

Figure 7:
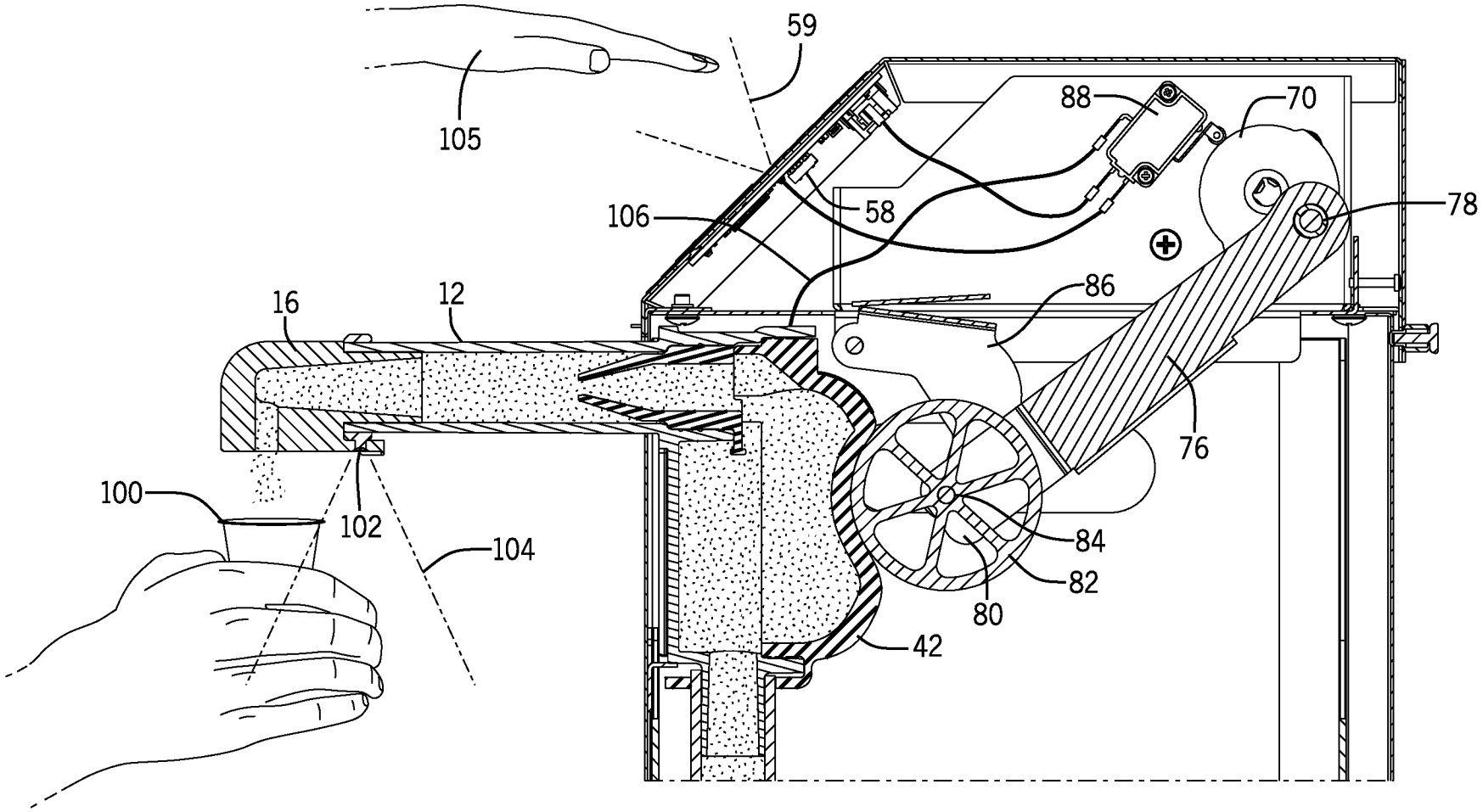
FIG. 7 is a magnified view of the automated pump actuation unit and the pump assembly of the food product dispenser prior to pumping.
Figure 8:
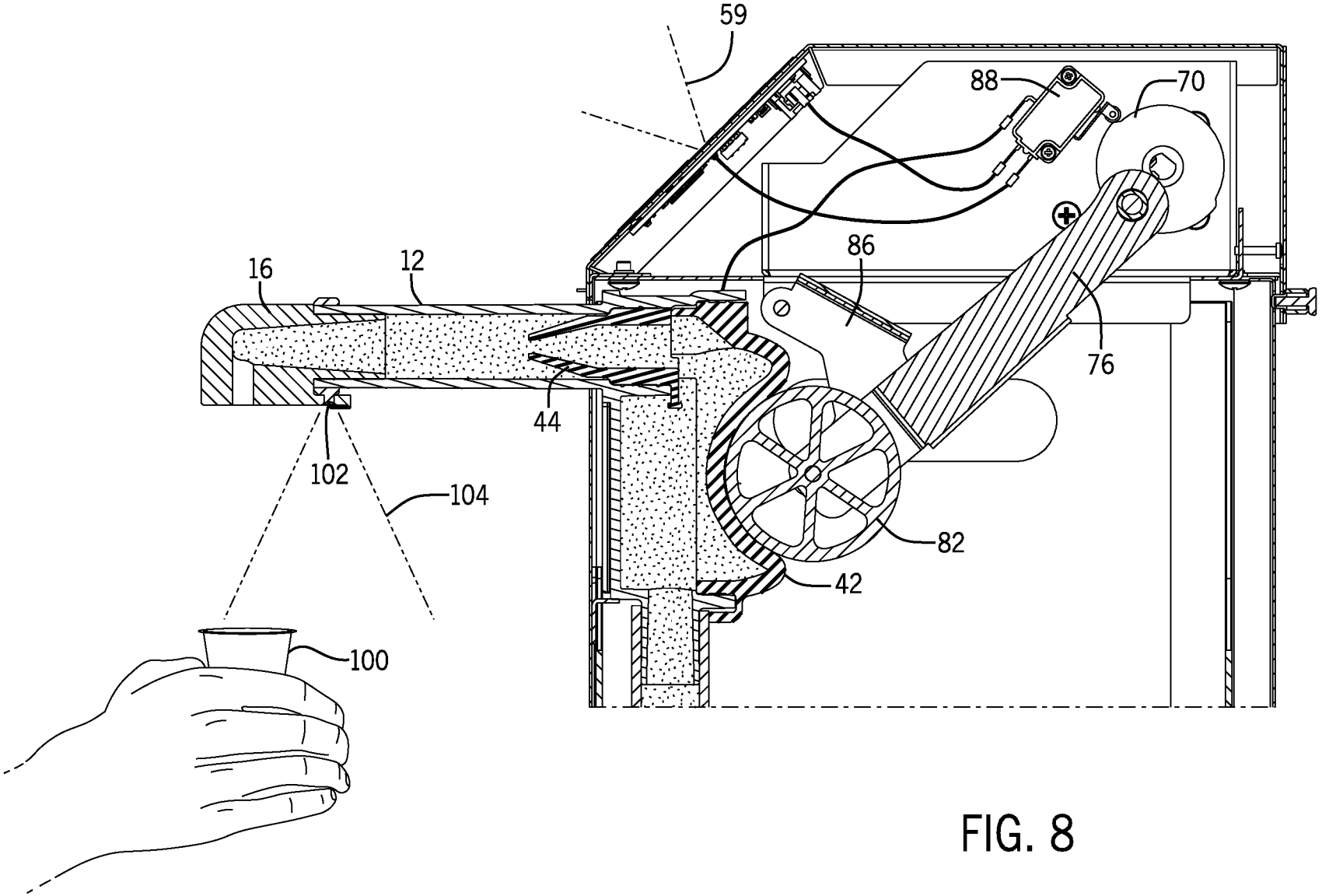
FIG. 8 is a view similar to FIG. 7 showing the dispensing of the food product.

As can be understood in FIGS. 7 and 8, when the cam 70 rotates as a result of rotation of the drive shaft 68 of the drive motor 66, the offset connection of the actuator arm 76 to the cam 70 through the pivot pin 78 causes the outer, second end 80 of the actuator arm 76 to move both vertically and horizontally.

Figure 9:
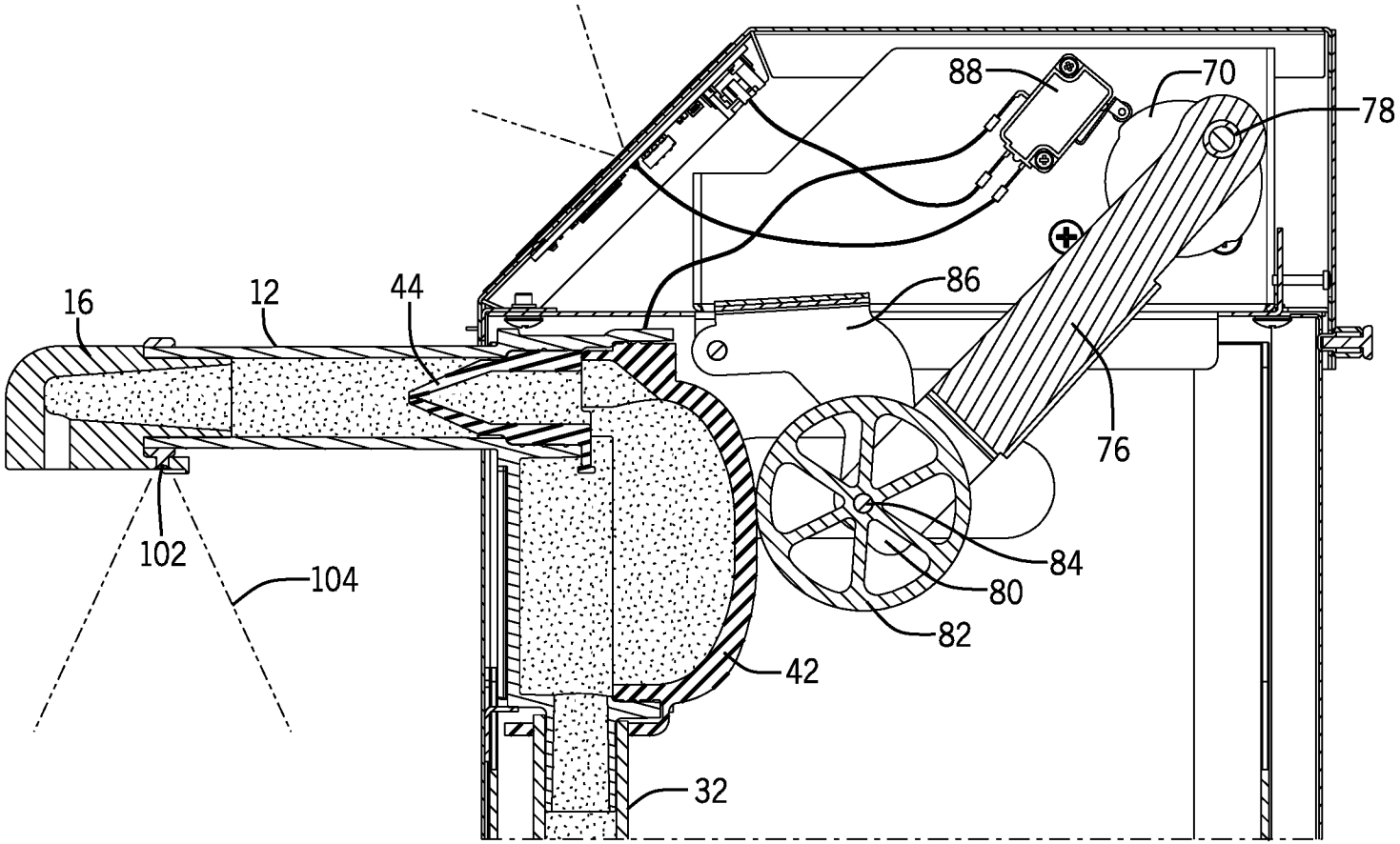
FIG. 9 is a view showing the removal of a food product cup after dispensing.

As can be seen in FIGS. 6-8, the outer end 80 of the actuator arm 76 receives and supports a roller 82. The roller 82 is rotatably supported on the second outer end 80 of the actuator arm 76 by a pin 84. The roller 82 is designed to move along the outer surface of the diaphragm 42 to compress the diaphragm 42, as can be seen in FIG. 8. Further rotation of the cam 70 moves the roller 82 away from the diaphragm 42 to release the diaphragm 42 as shown in FIG. 9.

In addition to the actuator arm 76, a wheel drive bracket arm 86 is also pivotally connected to help guide the movement of the roller 82 along the outer surface of the diaphragm 42. A switch 88 and spacer 90 are used to sense the movement of the cam 70, as is illustrated in the mounting arrangement of FIG. 5. The switch 88 is in communication with the control unit 61 on the control board 54 to provide monitoring information to the control unit 61.

During operation, as the cam 70 rotates, the roller 82 moves along the outer surface of the diaphragm 42 to compress the diaphragm 42 and cause food product to be dispensed into a container 100 or onto another food product through the nozzle 16, as shown in FIG. 8. Once the diaphragm 42 has been fully compressed by the roller 82, further rotation of the cam 70 causes the roller to both retract away from the diaphragm and upward to the condition shown in FIG. 7, thereby allowing the diaphragm 42 to create a negative source of pressure to draw additional food product into the pumping tube 32 in a conventional manner.

In an exemplary embodiment shown in FIG. 7, a second sensor 102 can be included in the nozzle 16. The second sensor 102 creates a second sensing cone 104 that is able to determine whether a condiment container 100 is within the sensing cone 104. A control wire 106 leads back to the switch 88 such that the switch 88 will only activate the drive motor when the sensor 102 detects the presence of the condiment container 100. The sensor 102 can be one of multiple different sensor types, such as an optical sensor or inductive sensor. Although the sensor 102 is shown in several of the drawing figures, the sensor 102 can be eliminated and only the single sensor 58 utilized to trigger operation of the automated pump actuation unit 17. The second sensor 102 could be used to make sure that a container 100 or food product is located in a position to receive the food product before the food product is dispensed.

As can be understood by the above description, the use of the automated pump actuation unit 17 can replace a conventional manual pump lever. During operation, when the sensor 58 detects the presence of a hand 105 (FIG. 7) within a sensing cone 59, the control unit 61 operates the drive motor 66 to rotate the drive shaft 68 a predetermined number of times to dispense the desired amount of food product. The control unit 61 will terminate operation of the drive motor 66 once the desired amount of food product has been dispensed. If the user removes his/her hand, the control unit 61 will reset and will begin the pumping operation again upon detection of the presence of the operator's hand. It is understood that the control unit can be programmed in various different manners to control the amount of material dispensed and the timing of the dispensing upon detecting the presence of a hand. Further, it is contemplated that the pumping can stop or start depending upon the presence of the operator's hand or can be programmed to dispense a predetermined amount of material each time the user's hand is detected.

As can be understood in FIGS. 1 and 2, the entire automated pump actuation unit 17 can be removed from the main body 14 as a single unit. The automated pump actuation unit 17 is designed to engage the pump assembly 26 as the automated pump actuation unit 17 is placed on the top edge of the main body 14. Since the entire pump actuator 17, including the cover member 18, mechanical actuator 48, control unit 61 and sensor 58 are assembled as a single unit, the automated pump actuation unit 17 could be used to retrofit existing food product dispensers that include a mechanical actuation handle. In such retrofit application, the flexible diaphragm pump would remain installed on the main body and the existing cover member and mechanical actuation handle would be removed from the main body. Once removed, the automated pump actuation unit 17 would be attached to the top end of the main body such that the mechanical actuator 48 would come into contact with the flexible diaphragm of the flexible diaphragm pump.

Once installed on the main body 14, the automated pump actuation unit 17 would operate as described above to depress and release the flexible diaphragm to pump food product out of the main body. The automated pump actuation unit 17 of the present disclosure allows for existing manual food products dispensers to be upgraded to a touch-free dispenser without having to replace the existing main body and flexible diaphragm pump. The automated pump actuation unit 17 is designed such that all of the operating components are removable as a single unit to facilitate the conversion of food product dispensers in this manner.

As indicated above, FIG. 10 is a schematic illustration of the components used to control the operation of the pump dispenser of the present disclosure. Many of the components shown in FIG. 10 are mounted to the control board contained within the cover member. As discussed above, the control unit 61 is operatively connected to many of the components to control the operation of the automated pump actuation unit. The control unit 61 is connected to the drive motor 66 such that the control unit 61 can control when and for how long the drive motor 66 operates. Since the operation of the drive motor 66 compresses and releases the diaphragm of the pump, the control unit 61 can control the amount of food product dispensed each time the hand of the user is detected. In one embodiment, the control unit 61 operates to dispense a defined volume of food product, such as 1 ounce, each time the hand of the user is detected. However, the owner/operator of the dispenser can change this amount depending upon the specific application.

In the embodiment shown in FIG. 10, a wireless communication device 65 allows the user to communicate with the control unit 61 to set various operating parameter, such as the amount of food product dispensed upon detection of the hand of the user. The operating parameters can be stored in the memory device 63. In addition to the amount of product dispensed, the control unit 61 can also control how long the hand of the user must be detected by the sensor 58 until the drive motor 66 is activated. For example, the control unit 61 can be programmed to active the drive motor 66 only when the hand has been continuously detected for one second. This parameter can also be modified by the user through communication to the control unit 61.

In the contemplated alternate embodiment, the second sensor 102 detect whether a hand, condiment holder or food item is below the dispensing spout 16. The second senor 102 is shown connected to the sensing switch 88. The sensing switch 88, in turn, is connected to both the control unit 61 and the drive motor. The sensing switch 88 allows the control unit 61 to monitor the operation of the drive motor 66 and prevents operation of the drive motor 66 when the second sensor 102 does not detect a hand, container or food item. As described previously, the second sensor 102 is optional and is not required for operation of the dispenser.

A cover detector switch 111 is positioned to detect when the cover member 18 is properly positioned on the main body of the dispenser. If the cover member is not properly installed, the control unit 61 will not allow the drive motor 66 to operate. The cover detector switch 111 is also shown in FIG. 6 and is mounted to a mounting plate 112 that extends perpendicular to the mounting plate 60. The cover detector switch 111 includes a wheel 114 that retracts when the cover member 18 is mounted to the main body. Specifically, the wheel 114 contacts the upper flange 116 on the main body 14, which is shown in FIG. 2. When the cover member 18 is installed on the main body 14, the front end of the cover member 18 is initially connected to the main body 14 and the cover member 18 pivots downward until the wheel 114 contacts the upper flange, causing the cover detector switch 111 to indicate attachment of the cover member 18 to the main body 14.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A food product dispenser operable to selectively dispense a food product as desired by a user, comprising:

a main body having an open interior sized to receive a supply of food product to be dispensed;

a pump assembly including a first end in fluid communication with the supply of food product and a dispensing end extending from the main body;

an electric drive motor operable to actuate the pump assembly to draw the supply of food product from the supply and discharge the food product from the dispensing end of the pump assembly;

a first sensor positioned on the main body and located remotely from the dispensing end of the pump assembly to detect the presence of an actuation member in proximity to the first sensor;

a second sensor positioned in close proximity to the dispensing end of the pump assembly to detect the presence of an object in proximity to the second sensor; and a control unit connected to the first sensor, the second sensor and the electric drive motor, wherein the control unit is operable to control the operation of the electric drive motor to activate the pump assembly based on the first sensor detecting the presence of the actuation member and the second sensor detecting the presence of the object.

2. The food product dispenser of claim 1 wherein the control unit operates the electric drive motor to automatically dispense a selected volume of food product upon detection of the actuation member and detection of the object.

3. The food product dispenser of claim 2 wherein the control unit operates the electric drive motor upon detecting the presence of the actuation member for longer than a sensing period.

4. The food product dispenser of claim 1 wherein the supply of food product is a flowable food product contained in a flexible pouch.

5. The food product dispenser of claim 1 wherein the supply of food product is received directly within the open interior of the main body.

6. The food product dispenser of claim 1 wherein the pump assembly includes a dispensing spout extending from the main body, wherein the dispensing spout includes the dispensing end and the second sensor.

7. An automated pump actuation unit for use with a food product dispenser including a main body having an open interior and a pump assembly including a first end in fluid communication with a supply of food product located within the open interior and a dispensing end extending from the main body, comprising:

an electric drive motor operable to actuate the pump assembly to draw the supply of food product from the supply and discharge the food product from the dispensing end of the pump assembly;

a first sensor positioned to detect the presence of an actuation member in proximity to the sensor;

a second sensor positioned in close proximity to the dispensing end of the pump assembly to detect the presence of an object in proximity to the second sensor; and a control unit connected to the first sensor, the second sensor and the electric drive motor, wherein the control unit is operable to control the operation of the electric drive motor to activate the pump assembly based on the first sensor detecting the presence of the actuation member and the second sensor detecting the presence of the object.

8. The automated pump actuation unit of claim 7 wherein the control unit operates the electric drive motor to automatically dispense a selected volume of food product upon detection of the actuation member.

9. The automated pump actuation unit of claim 7 wherein the control unit operates the electric drive motor upon detecting the presence of the actuation member for longer than a sensing period.

10. The food product dispenser of claim 7 wherein the pump assembly includes a dispensing spout extending from the main body, wherein the dispensing spout includes the dispensing end and the second sensor.

* * * * *